US011155996B2

(12) United States Patent
Dicorcia et al.

(10) Patent No.: US 11,155,996 B2
(45) Date of Patent: Oct. 26, 2021

(54) FASTENER-PROTECTING ROOFING SHINGLE

(71) Applicants: William P. Dicorcia, Brick, NJ (US); Brent A. Dicorcia, Brick, NJ (US)

(72) Inventors: William P. Dicorcia, Brick, NJ (US); Brent A. Dicorcia, Brick, NJ (US)

( * ) Notice: Subject to any disclaimer, the term of this patent is extended or adjusted under 35 U.S.C. 154(b) by 0 days.

(21) Appl. No.: 17/189,224

(22) Filed: Mar. 1, 2021

(65) Prior Publication Data

US 2021/0270037 A1 Sep. 2, 2021

Related U.S. Application Data

(60) Provisional application No. 62/983,349, filed on Feb. 28, 2020.

(51) Int. Cl.

| | |
|---|---|
| ***E04D 1/26*** | (2006.01) |
| ***E04D 1/36*** | (2006.01) |
| *E04D 1/20* | (2006.01) |
| *E04D 1/00* | (2006.01) |
| *E04D 1/34* | (2006.01) |

(52) U.S. Cl.

CPC ..... *E04D 1/26* (2013.01); *E04D 1/36* (2013.01); *E04D 1/20* (2013.01); *E04D 2001/005* (2013.01); *E04D 2001/3435* (2013.01)

(58) Field of Classification Search

CPC .... E04D 1/26; E04D 1/36; E04D 1/20; E04D 2001/005; E04D 2001/3435; E04D 1/365

USPC ..... 52/518–560

See application file for complete search history.

(56) References Cited

U.S. PATENT DOCUMENTS

| | | | | |
|---|---|---|---|---|
| 3,252,257 | A | 5/1966 | Price et al. | |
| 5,239,802 | A * | 8/1993 | Robinson | E04D 1/26 52/518 |
| 5,853,858 | A * | 12/1998 | Bondoc | E04D 1/26 428/195.1 |
| 6,494,010 | B1 * | 12/2002 | Brandon | E04D 1/29 52/578 |
| 6,895,724 | B2 | 5/2005 | Naipawer, III | |
| 7,204,063 | B2 | 4/2007 | Kandalgaonkar | |
| 8,607,521 | B2 | 12/2013 | Belt | |
| 8,984,835 | B2 | 3/2015 | Kalkanoglu et al. | |
| 9,758,970 | B2 * | 9/2017 | Grubka | E04D 1/29 |
| 10,358,824 | B2 * | 7/2019 | Aschenbeck | E04D 1/26 |
| 10,947,729 | B2 * | 3/2021 | Collins | E04D 1/20 |
| 2008/0134612 | A1 | 6/2008 | Koschitzky | |

* cited by examiner

*Primary Examiner* — Adriana Figueroa

(57) ABSTRACT

A fastener-protecting roofing shingle provides a solution for roofing nails or fasteners that become damaged due to weather exposure resulting from damaged roofing shingles. A nailing line is placed above a seamline rather than on or below the seamline, as is conventionally found. By placing the nailing line further from the seamline, which typically borders the exposed and the overlapped sections of a shingle, nails are better-protected from being exposed to the elements, which decreases the chances of failure due to the nail rusting. Due to the shift in the nailing line, a spotted adhesive may be positioned approximately two inches below the nailing line for improved rooftop adherence, and the length of a solid section may be increased. Furthermore, the apparatus directs rainwater straight down the roof. Solid adhesive strips prevent water from pooling or leaking laterally out to the sides and into other layers of shingling.

15 Claims, 6 Drawing Sheets

FASTENER-PROTECTING ROOFING SHINGLE

The current application claims a priority to the U.S. Provisional Patent application Ser. No. 62/983,349 filed on Feb. 28, 2020. The current application is filed on Mar. 1, 2021 while Feb. 28, 2021 was on a weekend.

FIELD OF THE INVENTION

The present invention relates generally to roof coverings. More specifically, the present invention is a roofing shingle with an advantageous arrangement of adhesives and construction lines that better protects nails and fastening equipment from degradation due to exposure.

BACKGROUND OF THE INVENTION

Roof shingles are a roof covering consisting of individual overlapping elements. These elements are typically flat, rectangular shapes that are laid in courses from the bottom edge of a roof up, with each successive course overlapping the joints below. Roof shingles are a very common roofing material globally. Roofing shingles are important for protecting the interior of a house or building and for contributing to a building's general aesthetics in patterns, textures and colors due to how highly visible they are. Many shingle installations benefit from being placed atop an underlayment material, such as asphalt felt paper, to prevent leaks even from wind-driven rain, snow, and ice dams in cold climates. Roof shingles boost the solidity and longevity of residential rooftops. Safeguarding the roof and enhancing the roofing beauty of a home are two of the key purposes of installing roof shingles. Furthermore, many roof shingles are non-combustible or have better fire ratings than others which provide additional fire protection.

Fiberglass-based asphalt shingles are the most common roofing material used for residential roofing. Asphalt shingles are easy to install, relatively affordable, and typically last between 20 and 50 years. Shingles tend to last longer where the weather stays consistent, either consistently warm, or consistently cool. Thermal shock fatigue resulting from dramatic fluctuations in ambient temperature within a short period of time can damage shingles. This is because over time, asphalt becomes oxidized, and consequently, brittle. The protective nature of asphalt shingles primarily comes from the long-chain hydrocarbons impregnating the paper.

Over time, in the hot sun, the hydrocarbons soften. Eventually, when rain falls, the softened hydrocarbons are gradually washed out of the shingles and down onto the ground. Along eaves and complex rooflines, more water is channeled, so the loss of hydrocarbons and oils occurs more quickly. Eventually, the loss of heavy oils causes the fibers in the roofing shingle to shrink, which exposes the nail heads under the shingle flap. The shrinkage also breaks up the surface coating of sand adhered to the surface of the paper and eventually causes the paper to begin to tear apart. Once the nail heads are exposed and rusted, water running down the roof can seep into the building around the nail shank, resulting in rotting of roof building materials and causing moisture damage to ceilings and paint inside. The placement of the nails on the roofing shingles may affect the rate in which the nail heads are exposed to the elements.

The Asphalt Roofing Manufacturers Association (ARMA) recommends that properly driven roofing nails be utilized as the fastening system for asphalt shingles. Nails are required in the International Building Code. Nails are never to be placed where they can be visibly exposed or weathered. Many roof shingles with sealant on the top surface are manufactured with a nailing line that is below a seamline but above the exposed area. This is typically around a half inch above the exposed area. It is highly recommended that the directions of manufactured roof shingles are followed extremely precisely and carefully in order to avoid any potential accidents or issues that may follow from faulty installation of roof shingles.

Due to the placement of the nails below the sealant strip of a typical roof shingle, the nails are more prone to overexposure and rust. Though the nails are not directly exposed to the environment and rather covered by the layered roof shingles, water from the rain can still leak over damaged shingles onto the nails. Many roof shingles are manufactured in such a way that rainwater can easily leak out from the sides of the shingles. Moisture can easily get under the layers of the roof shingles and cause leaks which can lead to molding and rotting.

The present invention is an improvement of a typical manufactured roof shingle. An objective of the present invention is to provide a solution for nails that become damaged due to weather exposure. The present invention places the nailing line above the seamline rather than on or below the seamline. By placing the nailing line further above the seamline, which typically borders an exposed section and overlapped section, the nails are further protected from being exposed to the elements. Nails are less likely to get wet by rainwater, which decreases the chances of rusting. The present invention shifts the nailing line to a position that is about 2.5 inches higher than the nailing line of a typical roof shingle. Due to the shift in the nailing line, a spotted adhesive may be positioned two inches below the nailing line and the length of a solid section may be increased.

Another objective of this present invention is to guide and direct rainwater straight down the roof and to prevent water from leaking out of the sides of a roofing shingle. The present invention places solid adhesive strips along the sides of the roofing shingle. The solid adhesive strips prevent water from creating puddles or leaking laterally out to the sides and into other layers of shingling. The solid adhesive strips can direct the rainwater vertically down the roof and prevent additional leaking.

DETAILED DESCRIPTION OF THE INVENTION

All illustrations of the drawings are for the purpose of describing selected versions of the present invention and are not intended to limit the scope of the present invention.

Figure 1:
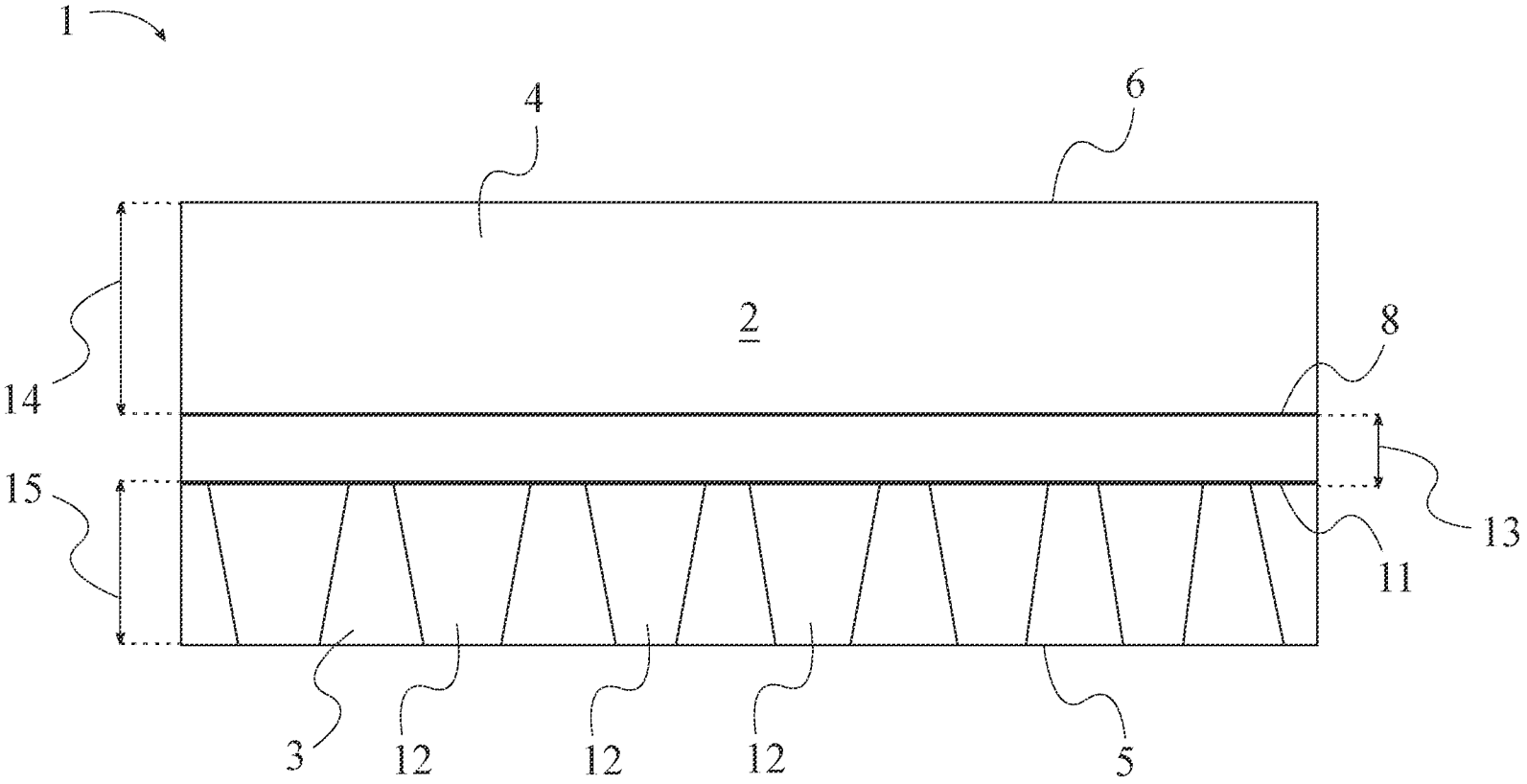
FIG. 1 is a front view of the present invention.

The present invention is a fastener-protecting roofing shingle that provides a solution for roofing nails or fasteners that become damaged due to weather exposure resulting from damaged roofing shingles. The general configuration of the aforementioned components allows the present invention to efficiently and effectively protect nails from being exposed to the elements, which decreases the chances of shingle failure due to the nail rusting. The present invention may comprise a shingle body 1, a nailing indicator 8, at least one quantity of liquid sealing adhesive 9, a plurality of adhesive strips 10, and a separation plane 11. The shingle body 1 denotes the volume occupied by the present invention, as shown in FIG. 1. The nailing indicator 8 is a flat line which is used to demarcate the area which, in the preferred usage of the present invention, is intended for nailing. The at least one quantity of liquid sealing adhesive 9 is a linear pattern of liquid sealant, epoxy, glue, or other such adhesive materials capable of connecting the shingle body 1 to a rooftop. The plurality of adhesive strips 10 relates to a set of adhesive units which, in the preferred usage of the present invention, prevent fluid from flowing laterally between rooftop shingles. Each strip of the plurality of adhesive strips 10 may also utilize a removable protective cellophane strip in order to improve transportability and prevent undesirable or unintended connection of the plurality of adhesive strips 10 to various surfaces. The separation plane 11 is a two-dimensional surface which perpendicularly intersects the shingle body 1, effectively dividing the shingle body 1 into two parts.

Figure 3:
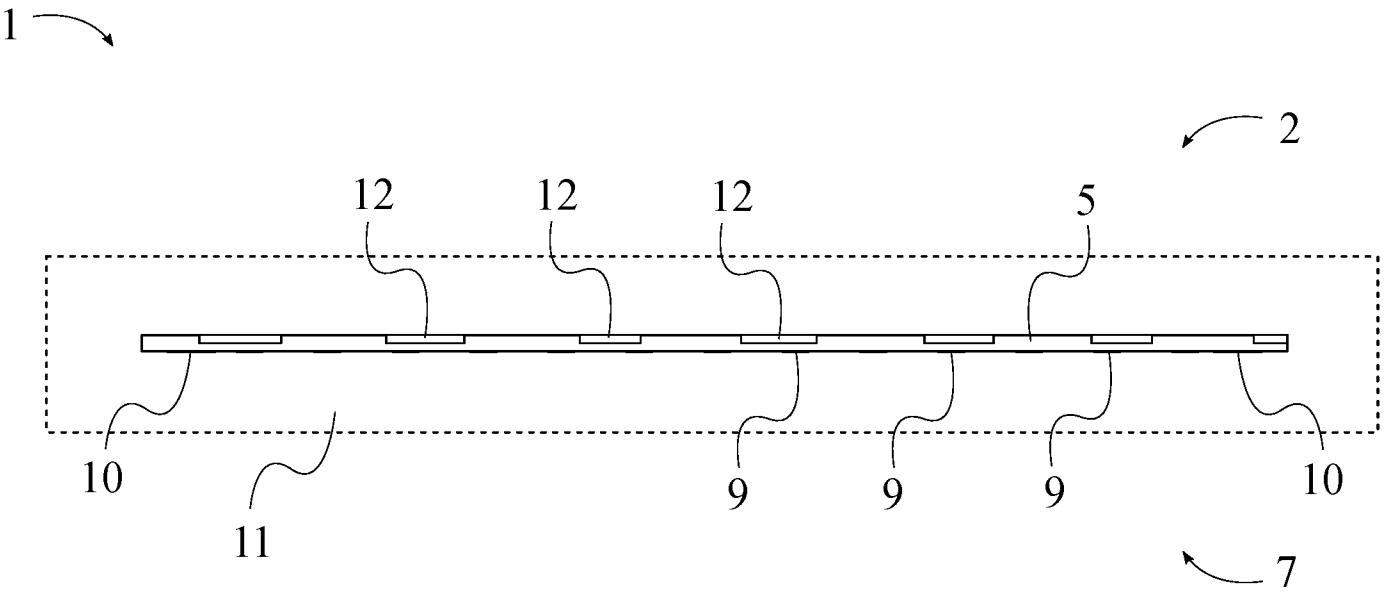
FIG. 3 is a bottom view of the present invention.

This arrangement of components enables the present invention to efficiently and effectively protect both rooftops and roofing materials. The shingle body 1 may comprise a first face 2 and a second face 7, as shown in FIG. 3. The first face 2 denotes the surface which, in the preferred usage of the present invention, is generally oriented away from a rooftop. Conversely, the second face 7 denotes the surface which, in the preferred usage of the present invention, is generally oriented towards a rooftop. The first face 2 may comprise an exposed portion 3, an unexposed portion 4, an exposed edge 5, and a covered edge 6. The exposed portion 3 is the segment of the shingle body 1 which extends beyond the protection of an overlapping roofing shingle. The unexposed portion 4 is the segment of the shingle body 1 which is covered by an overlapping roofing shingle. The exposed edge 5 is the edge of the shingle body 1 which extends furthest out beyond coverage of an overlapping roofing shingle. The covered edge 6 denotes the edge of the shingle body 1 which is furthest under the cover of an overlapping roofing shingle, in the preferred usage of the present invention. The first face 2 and the second face 7 are positioned opposite to each other about the shingle body 1. This arrangement positions the first face 2 adjacent to environmental elements and the second face 7 adjacent to the rooftop. The exposed portion 3 and the unexposed portion 4 are positioned adjacent to each other along the separation plane 11. In this way, the separation plane 11 serves as the divider between the covered and uncovered segments of the shingle body 1.

The exposed edge 5 is positioned opposite to the separation plane 11 across the exposed portion 3, as shown in FIG. 3. Thus, the exposed edge 5 defines the portion of the shingle body 1 that, in the preferred usage of the present invention, is most exposed to the elements. The covered edge 6 is positioned opposite to the separation plane 11 across the unexposed portion 4. This arrangement ensures that the covered edge 6 is the edge of the shingle body 1 that is best-protected from environmental stimuli, thereby implying that optimally-placed nails should be positioned generally closer to the covered edge 6. The nailing indicator 8 is integrated across the unexposed portion 4. In this way, the nailing indicator 8 is visible during installation of the present invention. The nailing indicator 8 is positioned parallel to and offset from the separation plane 11. This is an advantageous departure from conventional roofing shingles, ensuring that nails are placed closer to the better-protected covered edge 6. The plurality of adhesive strips 10 is peripherally connected upon the second face 7. Thus, the plurality of adhesive strips 10 is able to direct the flow of rainwater into desirable directions during use. The at least one quantity of liquid sealing adhesive 9 is connected upon the second face 7 in between the plurality of adhesive strips 10. This arrangement ensures optimal connection strength of the present invention to a rooftop. The at least one quantity of liquid sealing adhesive 9 is positioned across the second face 7. In this way, the at least one quantity of liquid sealing adhesive 9 may fully or partially join the second face 7 to a rooftop, as desirable.

Figure 2:
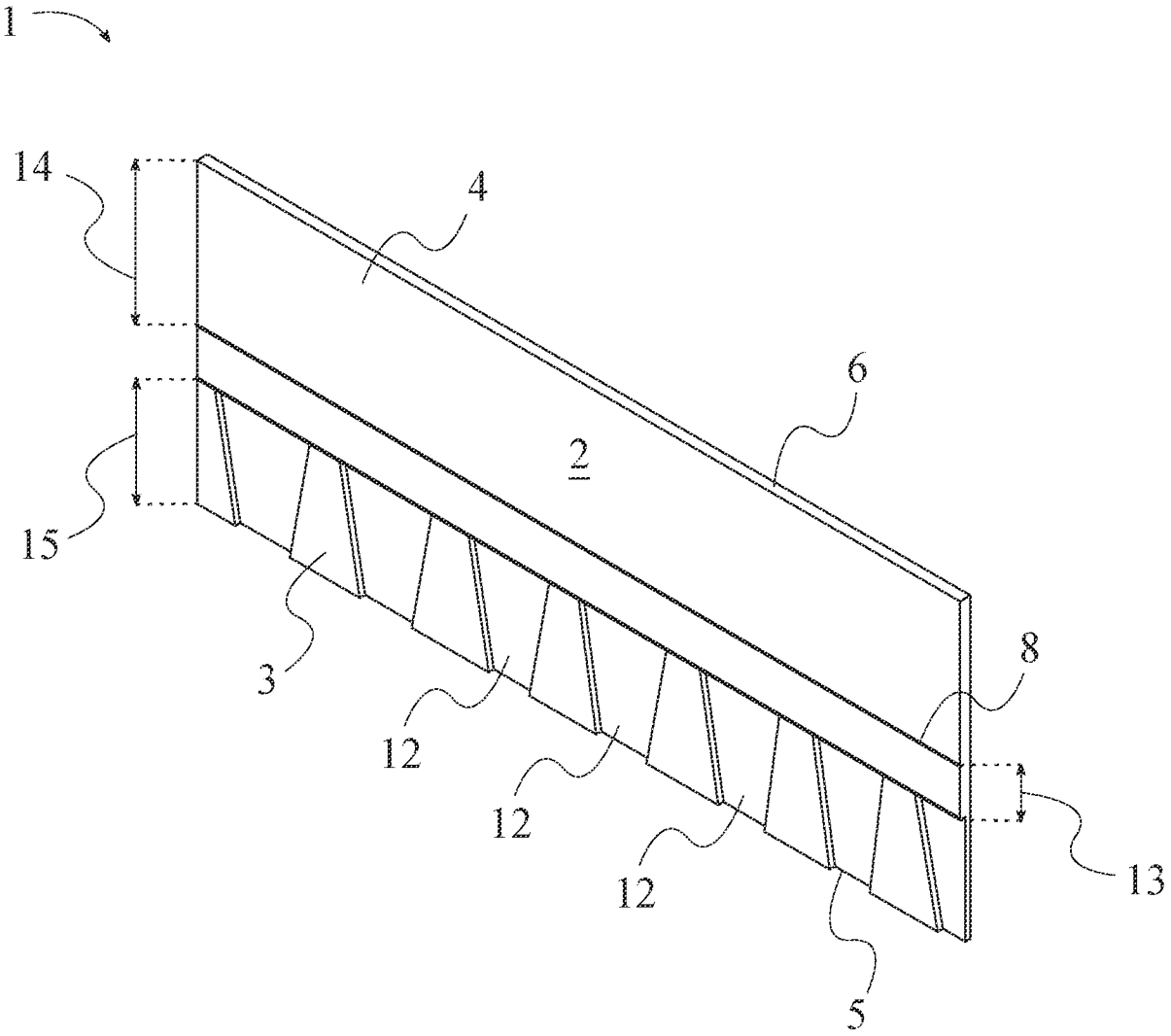
FIG. 2 is a front perspective view of the present invention.

In order to ensure that fluid, especially rainwater and other rooftop runoff water, can escape the roof effectively, it may be advantageous for the present invention to include further mechanisms for redirecting water. To this end, the present invention may further comprise a plurality of fluid channels 12, as shown in FIG. 2. The plurality of fluid channels 12 is a set of cuts or features which may guide the flow of water off of a rooftop. The plurality of fluid channels 12 traverses into the shingle body 1 from the exposed portion 3. This arrangement orients the plurality of fluid channels 12 in such a way as to ensure that rainwater is guided appropriately along the plurality of fluid channels 12.

It may be further advantageous to ensure that the plurality of fluid channels 12 is arranged to channel water in the right direction. To this end, each of the plurality of fluid channels 12 traverses from the separation plane 11 to the exposed edge 5, as shown in FIG. 1. Thus, any water upon the exposed portion 3 may be directed be the plurality of fluid channels 12. Furthermore, each of the plurality of fluid channels 12 tapers from the separation plane 11 to the exposed edge 5. In this way, water is funneled, or otherwise directed, away from the lateral edges of adjacent roofing shingles.

Figure 4:
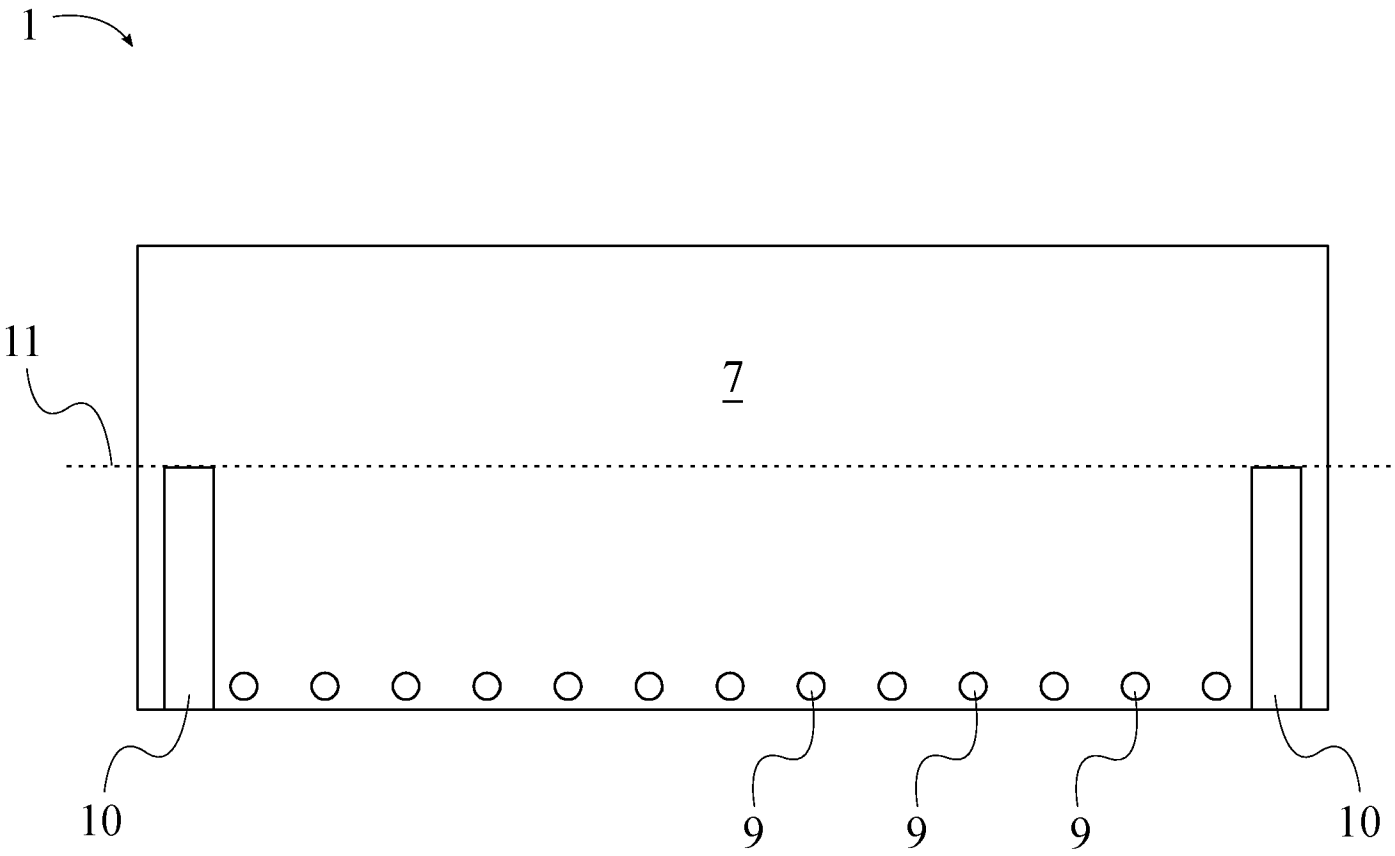
FIG. 4 is a rear view of the present invention.

The at least one quantity of liquid sealing adhesive 9 must be positioned appropriately to enable secure attachment of the shingle body 1 to a rooftop. To this end, the at least one quantity of liquid sealing adhesive 9 may be arranged in a spotted linear pattern between the plurality of adhesive strips 10, wherein the spotted linear pattern is positioned adjacent to the exposed edge 5, as shown in FIG. 4. This arrangement enables the at least one quantity of liquid sealing adhesive 9 to cover an appropriate amount of surface area upon the second face 7.

Figure 5:
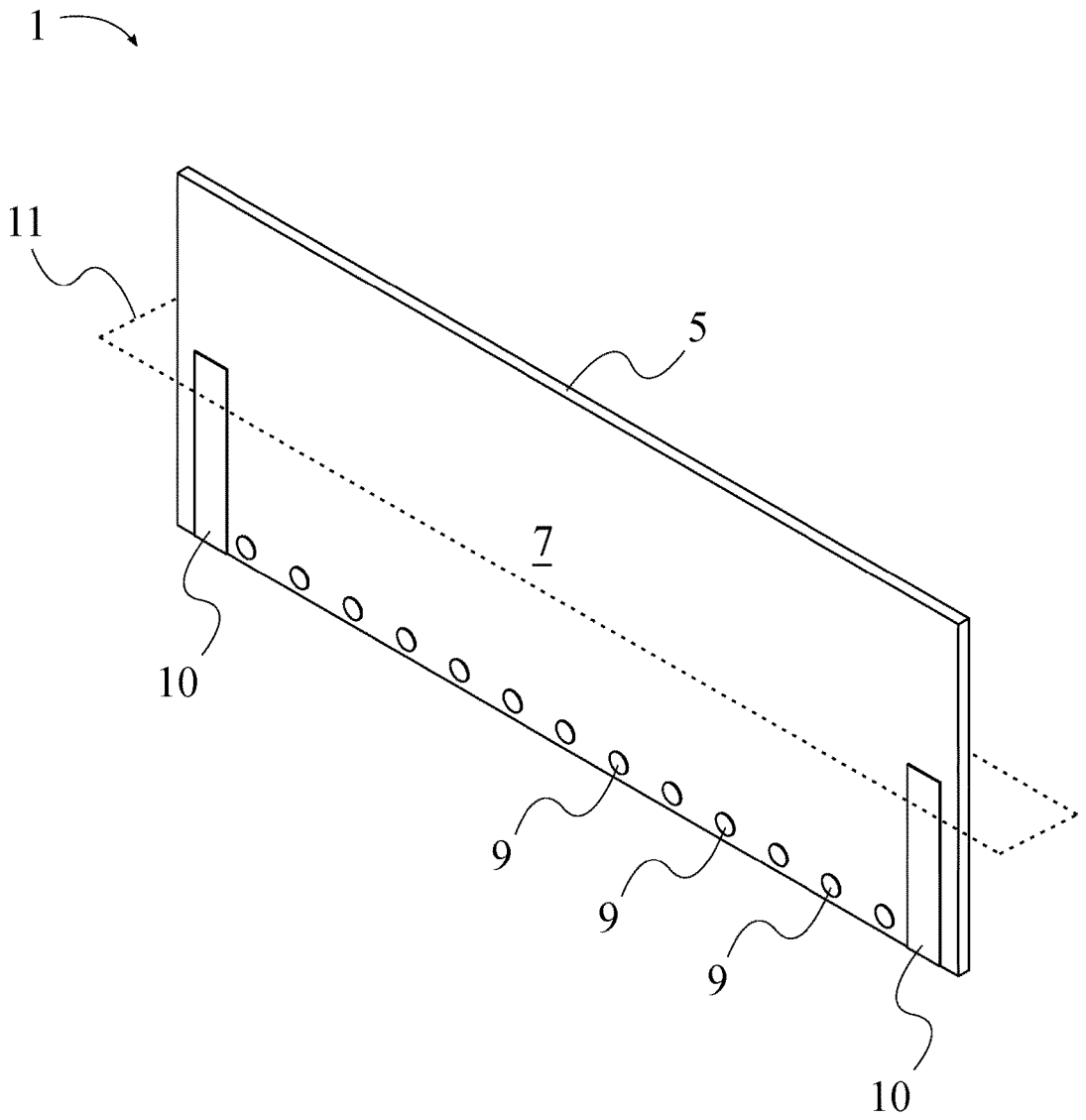
FIG. 5 is a rear perspective view of the present invention.
Figure 6:
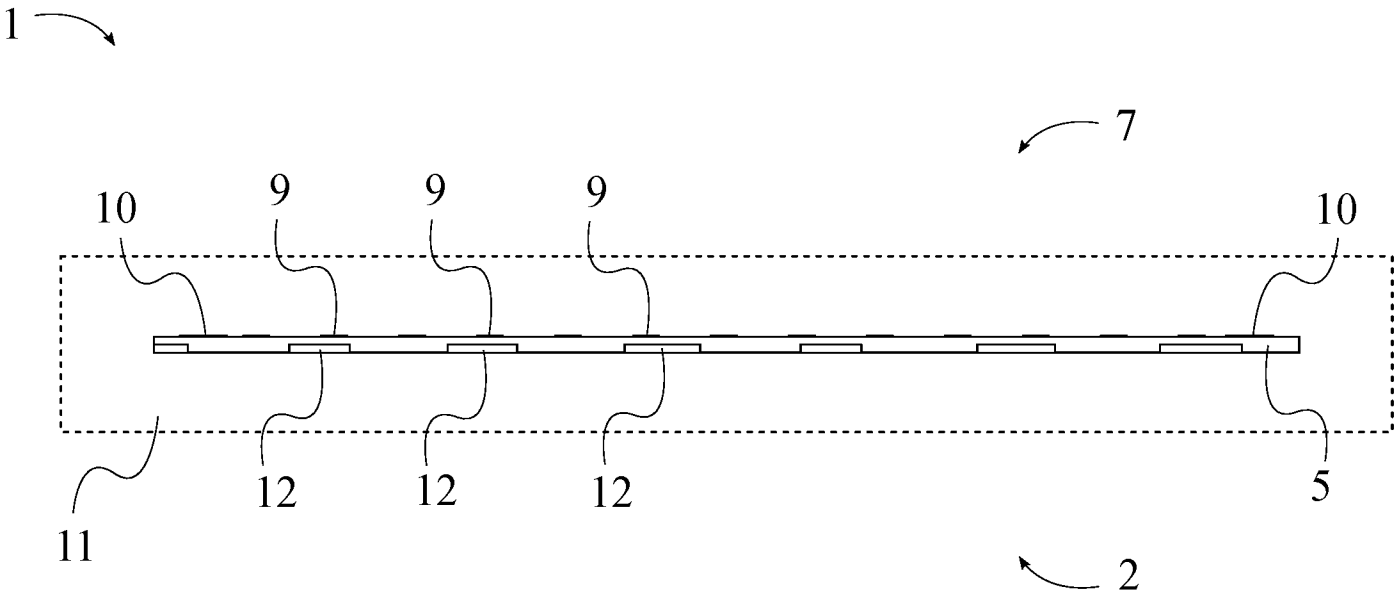
FIG. 6 is a bottom view of the present invention.

The plurality of adhesive strips 10 must be capable of both securing the shingle body 1 upon a rooftop and preventing water from contacting nails that pierce through the shingle body 1 during the mounting process. Thus, the plurality of adhesive strips 10 may span across the second face 7 up to the separation plane 11, as shown in FIGS. 5 and 6. In this way, the plurality of adhesive strips 10 covers an appropriate surface area, preventing water from being able to enter into the nailing area.

Among the most important distinguishing features of the present invention is the separation between the nailing indicator 8 and the separation plane 11. A first distance 13 between the nailing indicator 8 and the separation plane 11 may be 2.5 inches, as shown in FIG. 1. This distance has been found to be optimal in both maximizing nail protection and ensuring firm attachment of the present invention to a rooftop.

A user of the present invention may desire increased nailing room in order to optimally fasten nails into the unexposed portion 4. To provide for this, a second distance 14 between the nailing indicator 8 and the covered edge 6 of the unexposed portion 4 may be 5.625 inches, as shown in FIG. 1. In this way, the shingle body 1 is generally longer than existing roofing shingles, providing more nailing area and more overlap coverage for each nail.

The exposed portion 3 must sufficiently extend beyond the separation plane 11 in order to protect the roof and the roofing shingles below. To this end, a third distance 15 between the exposed edge 5 and the separation plane 11 is 5.625 inches, as shown in FIG. 1. This length has been found to be optimal for providing rooftop coverage.

Although the invention has been explained in relation to its preferred embodiment, it is to be understood that many other possible modifications and variations can be made without departing from the spirit and scope of the invention as hereinafter claimed.

What is claimed is:

1. A fastener-protecting roofing shingle comprises:
- a shingle body;
- a nailing indicator;
- at least one quantity of liquid sealing adhesive;
- a plurality of adhesive strips;
- a separation plane;
- the shingle body comprises a first face and a second face;
- the first face comprises an exposed portion, an unexposed portion, an exposed edge, and a covered edge;
- the first face and the second face being positioned opposite to each other about the shingle body;
- the exposed portion and the unexposed portion being positioned adjacent to each other along the separation plane;
- the exposed edge being positioned opposite to the separation plane across the exposed portion;
- the covered edge being positioned opposite to the separation plane across the unexposed portion;
- the nailing indicator being integrated across the unexposed portion;
- the nailing indicator being positioned parallel to and offset from the separation plane;
- the plurality of adhesive strips being peripherally connected upon the second face;
- the at least one quantity of liquid sealing adhesive being connected upon the second face in between the plurality of adhesive strips; and
- the at least one quantity of liquid sealing adhesive being positioned across the second face.

2. The fastener-protecting roofing shingle as claimed in claim 1 comprises:
- a plurality of fluid channels; and
- the plurality of fluid channels traversing into the shingle body from the exposed portion.

3. The fastener-protecting roofing shingle as claimed in claim 2 comprises:
- each of the plurality of fluid channels traversing from the separation plane to the exposed edge; and
- each of the plurality of fluid channels tapering from the separation plane to the exposed edge.

4. The fastener-protecting roofing shingle as claimed in claim 1, wherein the at least one quantity of liquid sealing adhesive is arranged in a spotted linear pattern between the plurality of adhesive strips, and wherein the spotted linear pattern is positioned adjacent to the exposed edge.

5. The fastener-protecting roofing shingle as claimed in claim 1, wherein the plurality of adhesive strips spans across the second face up to the separation plane.

6. The fastener-protecting roofing shingle as claimed in claim 1, wherein a first distance between the nailing indicator and the separation plane is 2.5 inches.

7. The fastener-protecting roofing shingle as claimed in claim 1, wherein a second distance between the nailing indicator and the covered edge of the unexposed portion is 5.625 inches.

8. The fastener-protecting roofing shingle as claimed in claim 1, wherein a third distance between the exposed edge and the separation plane is 5.625 inches.

9. A fastener-protecting roofing shingle comprises:
- a shingle body;
- a nailing indicator;
- at least one quantity of liquid sealing adhesive;
- a plurality of adhesive strips;
- a separation plane;
- a plurality of fluid channels;
- the shingle body comprises a first face and a second face;
- the first face comprises an exposed portion, an unexposed portion, an exposed edge, and a covered edge;
- the first face and the second face being positioned opposite to each other about the shingle body;
- the exposed portion and the unexposed portion being positioned adjacent to each other along the separation plane;
- the exposed edge being positioned opposite to the separation plane across the exposed portion;
- the covered edge being positioned opposite to the separation plane across the unexposed portion;
- the nailing indicator being integrated across the unexposed portion;
- the nailing indicator being positioned parallel to and offset from the separation plane;
- the plurality of adhesive strips being peripherally connected upon the second face;
- the at least one quantity of liquid sealing adhesive being connected upon the second face in between the plurality of adhesive strips;
- the at least one quantity of liquid sealing adhesive being positioned across the second face; and
- the plurality of fluid channels traversing into the shingle body from the exposed portion.

10. The fastener-protecting roofing shingle as claimed in claim 9 comprises:
- each of the plurality of fluid channels traversing from the separation plane to the exposed edge; and
- each of the plurality of fluid channels tapering from the separation plane to the exposed edge.

11. The fastener-protecting roofing shingle as claimed in claim 9, wherein the at least one quantity of liquid sealing adhesive is arranged in a spotted linear pattern between the plurality of adhesive strips, and wherein the spotted linear pattern is positioned adjacent to the exposed edge.

12. The fastener-protecting roofing shingle as claimed in claim 9, wherein the plurality of adhesive strips spans across the second face up to the separation plane.

13. The fastener-protecting roofing shingle as claimed in claim 9, wherein a first distance between the nailing indicator and the separation plane is 2.5 inches.

14. The fastener-protecting roofing shingle as claimed in claim 9, wherein a second distance between the nailing indicator and the covered edge of the unexposed portion is 5.625 inches.

15. The fastener-protecting roofing shingle as claimed in claim 9, wherein a third distance between the exposed edge and the separation plane is 5.625 inches.

* * * * *